US005138645A

United States Patent [19]

Penato et al.

[11] Patent Number: 5,138,645

[45] Date of Patent: Aug. 11, 1992

[54] ANODE FOR X-RAY TUBES

[75] Inventors: Jean-Marie Penato, Les Essarts-Le-Roi; Emile Gabbay, Paris, both of France

[73] Assignee: General Electric CGR S.A., Issy Les Moulineaux, France

[21] Appl. No.: 619,889

[22] Filed: Nov. 27, 1990

[30] Foreign Application Priority Data

Nov. 28, 1989 [FR] France ..... 89 15633

[51] Int. Cl.[5] ..... H01J 35/10

[52] U.S. Cl. ..... 378/144; 378/143

[58] Field of Search ..... 378/143, 144

[56] References Cited

U.S. PATENT DOCUMENTS 3,711,736 1/1973 Gabbay .
4,250,425 2/1981 Gabbay et al. .
4,292,563 9/1981 Gabbay et al. .
4,298,816 11/1981 Hirsch et al. .
4,352,041 9/1982 Hubner et al. ..... 378/144
4,352,196 9/1982 Gabbay .
4,415,529 11/1983 Masumoto et al. .
4,461,020 7/1984 Hubner et al. ..... 378/144
4,472,827 9/1984 Gabbay et al. .
4,571,286 2/1986 Penato .
4,596,028 6/1986 Gabbay .
4,608,707 8/1986 Gabbay et al. .
4,670,895 6/1987 Penato .
4,675,890 6/1987 Plessis et al. .
4,731,807 3/1988 Plessis et al. .
4,780,900 10/1988 Gabbay et al. .
4,780,901 10/1988 Gabbay et al. .
4,799,250 1/1989 Penato et al. .
4,920,554 4/1990 Gabbay et al. .
4,958,364 9/1990 Guerin et al. .
4,964,147 10/1990 Laurent et al. .

FOREIGN PATENT DOCUMENTS 0031940 7/1981 European Pat. Off. .
0062380 10/1982 European Pat. Off. .
61-66349 4/1986 Japan .

OTHER PUBLICATIONS

Journal of Less-Common Metals, vol. 1, Feb. 1959, Elsevier-Sequoia, Lausanne, CH, pp. 19-33; R. Kieffer et al., "Tungsten alloys of high melting point", pp. 22-25; FIGS. 9, 13.

*Primary Examiner*—Craig E. Church
*Attorney, Agent, or Firm*—Cushman, Darby & Cushman

[57] ABSTRACT

The disclosure concerns anodes for X-ray tubes. The disclosed anode for an X-ray tube has a body or substrate on which a target is provided by a layer of target material, wherein said anode comprises at least one layer that is interposed between said substrate and said target layer and is constituted by a material having greater plasticity than the material forming the substrate and the target material.

12 Claims, 1 Drawing Sheet

FIG. 1
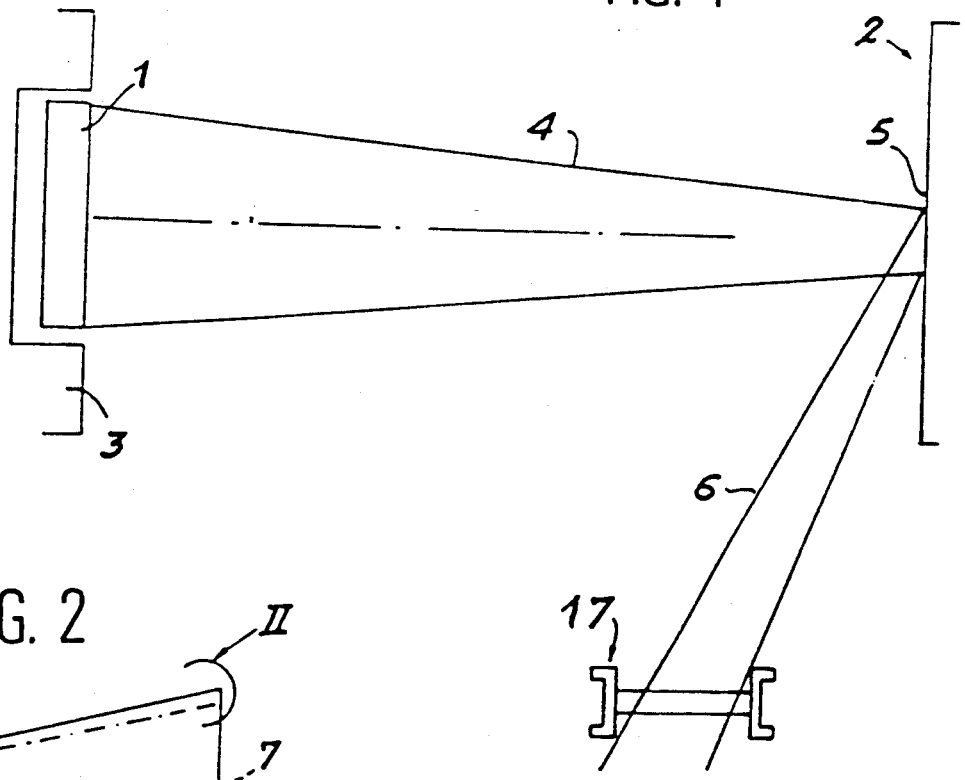
FIG. 2
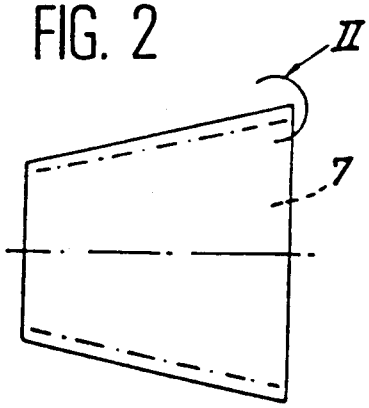
FIG. 3
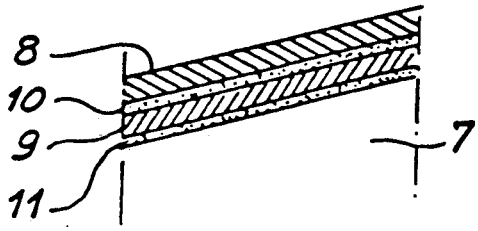
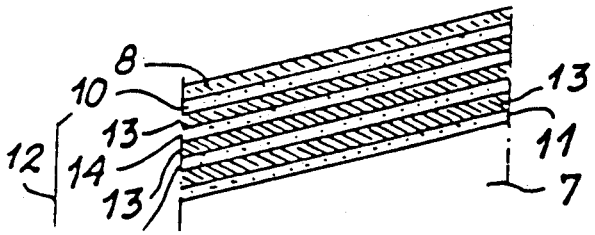
FIG. 4

ANODE FOR X-RAY TUBES

BACKGROUND OF THE INVENTION

1. Field of the Invention

The invention concerns an X-ray tube anode, more particularly a rotating anode of the type having a main body that bears a target formed by a surface layer of an X-ray emitting material.

2. Description of the Prior Art

In X-ray tubes, notably those used for X-ray diagnosis, the X-radiation is obtained under the effect of an electron bombardment of a layer of a target material, i.e. generally a material, with a high atomic number, that is refractory and is a good conductor of heat such as, for example, tungsten, molybdenum or an alloy containing at least one of these elements. These are the most commonly used elements, but the invention is not restricted to an anode with an emissive material containing these elements or their alloys.

The target layer is bombarded on a small surface, called a focal spot, forming the source of the radiation.

For a long time now, the high instantaneous power values (of the order of 100 KW) used and the small dimensions of the focal spot have led to the use of rotating anodes in order to distribute the heat flux over a greater area than that of the focal spot so as to dissipate it more efficiently.

This distribution and dissipation of heat is all the more efficient as the linear speed of rotation of the anode is high.

However, this linear speed is limited by the mechanical strength of the anode and, notably, the risks of its breaking up due to the formation of cracks, notably in the material forming the target layer, which spread into the other materials forming the anode.

In fact, rotating anodes are generally formed by a base or substrate forming a block with a regular shape such as the shape of a disk, a cone or similar shape, on which one or more layers of an X-ray emitting material or target material are deposited. Generally, the adhesion of the layer of target material to the base is improved by the deposition of an intermediate anchoring layer thus creating a certain continuity between the emitting material and the material forming the substrate, for example by surface diffusion of the anchoring material into the other two materials or vice versa. This continuity may favor the spread of the cracks generated in the emitting material.

The invention is designed notably to overcome these drawbacks by proposing an anode comprising a particular structure that prevents the cracks, caused in the emitting material, from spreading towards the base or substrate, or from spreading in the reverse direction.

SUMMARY OF THE INVENTION

To this effect, the invention proposes an anode for an X-ray tube, for example a rotating anode, having a body or substrate on which a target is formed by a layer of target material, wherein said anode comprises at least one layer interposed between said target layer and the substrate, constituted by a material having greater "plasticity" than the material forming the substrate and the target material.

This layer of plastic material absorbs and attenuates the stresses caused by the formation of a crack in the target material or the substrate. Thus, since the risks of cracks in this material are appreciably smaller, owing to its capacity for changing shape or getting deformed, the spread of these cracks will be stopped or appreciably attenuated. This layer of material of plastic quality may also reduce the risk of the formation of these cracks by absorption of the deformations of the layer of emitting material.

By the plasticity of a material is meant the ability of the material to get deformed (i.e. to change shape) permanently. Thus, for example, a material having high ductility displays high plasticity.

To reinforce this effect, the invention proposes a second embodiment of the invention wherein a multiple-layer structure is interposed between the target layer and the substrate, said multiple-layer structure being formed by several layers superimposed in parallel to the target layer and being formed, alternately, by a material with high plasticity and a material with low plasticity.

According to another feature of the invention, an anchoring layer is interposed between, firstly, the target layer and the layer made of plastic material or the multiple-layer structure and, secondly, between the substrate or body and the layer of plastic material or the multiple-layer structure.

Advantageously, in the second embodiment of the invention, the anchoring layers form the external layers of the multiple-layer structure.

The material or materials forming the plastic layer or the multiple-layer structure should, of course, have a melting temperature that is higher than the operating temperature of the anode and, notably, that of the focal spot.

Moreover, in these materials, the property appropriate to the invention, such as plasticity, should be displayed at all the temperatures of operation of the tube. These temperatures of operation are generally between ambient temperature and 1400° C.

The materials suitable for the invention are generally metal elements or metal alloys.

In a preferred embodiment of the invention, the material forming the plastic layer or forming the layers of the multiple-layer structure is an alloy of elements forming the target layer such as, for example, a tungsten alloy or molybdenum alloy, the plasticity of this alloy being controlled by its composition. As an example, tantalum, niobium or their alloys might be cited as materials having plasticity appropriate to the invention. The shape and the material or materials forming the body or substrate are not of essential importance for the invention. Thus, for example, the body may be formed by a metallic, carbon block or a block of composite material such as a carbon-carbon composite machined to a desired shape, or by several elements made of identical or different elements assembled, for example, by brazing.

The layers forming the plastic layer, the multiple-layer structure, the target layer and, possibly, the anchoring layers are deposited successively on the surface of the base by the usual techniques such as the methods of chemical vapor deposition (CVD) and physical vapor deposition (PVD), or by electrolysis or plasma torch for example.

Another object of the invention is an X-ray tube including a rotating anode such as is described here above.

BRIEF DESCRIPTION OF THE DRAWINGS

Other objects, advantages and features of the invention will appear more clearly in the light of the examples, given below, of embodiments of the invention, and from the description of these embodiments, made with reference to the appended figures, which are given purely as an indication, and wherein:

FIG. 1 is a schematic and simplified representation of an X-ray tube;

FIG. 2 is a schematic view, in longitudinal section, of an anode according to the invention;

FIG. 3 is a schematic view, drawn to an enlarged scale, of the part II of FIG. 2, according to a first embodiment of the invention, and FIG. 4 is a schematic view, drawn to an enlarged scale, of the part II of FIG. 2, according to a second embodiment of the invention.

DESCRIPTION OF PREFERRED EMBODIMENTS

Referring to FIG. 1, an X-ray tube comprises, in an empty chamber (not shown), a cathode 1 located so as to face an anode 2. The cathode 1 is inserted in an optical focusing set 3 enabling the electron beam 4 emitted by the cathode to be guided towards and focused on a small surface 5 of the anode 2 called a focal spot.

The emission of the electron beam 4 by the cathode is generated by the heating of a filament (not shown) to a high temperature.

The anode 2 receives the electron beam 4, and emits an X-ray beam referenced 6, notably towards a window 17 provided, for example, on the envelope of the tube. The anode 2 is mounted on a rotationally driven shaft (not shown). Thus, the focal spot 5 is a ring of small width defined on the surface of the anode 2.

Referring to FIGS. 2, 3 and 4, two embodiments of the invention will be now described.

The anode 2 has a body or substrate 7, having a conical shape in the example shown, on the external surface of which there is placed a set of layers having the structure shown in FIGS. 3 and 4.

Thus, in a first embodiment of the invention, the most external layer 8 is the target layer formed by an X-radiation emitting material. Interposed between the substrate 7 and this target layer 8, a layer 9, made of a material of plastic quality, is deposited.

In the embodiment shown, an anchoring layer 10, 11 is deposited between, on the one hand, the substrate and the layer 9 and, secondly, the layer 9 and the target layer 8.

Here below, an example of the thickness and composition of these different layers is given:

| Layer | Material | Thickness |
|---|---|---|
| Target 8 | Alloy W = 96%<br>Re = 4% | 50 to 300 micrometers |
| Anchoring layer 10 | Alloy W = 90%<br>Re = 10% | 50 to 300 micrometers |
| Plastic material 9 | Alloy W = 74%<br>Re = 26% | 50 to 300 micrometers |
| Anchoring layer 11 | Rhenium | 5 micrometers |

In a second embodiment, illustrated by FIG. 4, the target layer 8 and the anchoring layers 10 and 11 are identical to those of the first embodiment. According to the invention, a multiple-layer structure 12 is interposed between the target layer 8 and the substrate 7. This structure is formed by a stacking of layers 13, 14 made of materials displaying different characteristics of plasticity. Thus, the layers 13 have high plasticity while the layers 14 cannot be deformed. This succession of interfaces between plastic layer and non-plastic layer further diminishes the ease with which a crack can spread. Here below, an example of the composition of such a structure is given :

| Layer | Material | Thickness |
|---|---|---|
| Layers 13 | Alloy W = 74%<br>Re = 26% | 50 to 100 micrometers |
| Layers 14 | Alloy W = 90%<br>Re = 10% | 50 to 100 micrometers |

Another example of the structure 12 is given below:

| Layer | Material | Thickness |
|---|---|---|
| Layers 13 | Tantalum or Niobium | 50 to 100 micrometers |
| Layers 14 | Alloy W = 90%<br>Re = 10% | 50 to 100 micrometers |

What is claimed is:

1. An anode for an X-ray tube having a body or substrate on which a target is formed by a layer of target material, wherein said anode further comprises:

a multiple-layer structure as a means for preventing cracks from spreading between said substrate and said target layer, said structure being formed by several plastic layers of alternating high plasticity material and low plasticity material, superimposed in parallel to said target layer;

a first anchoring layer for anchoring said target layer to said multiple-layer structure; and a second anchoring layer for anchoring said multiple-layer structure to said substrate;

said multiple-layer structure being interposed between said first and second anchoring layers.

2. An anode according to claim 1, wherein the substrate is a composite structure comprising several elements fabricated in different materials.

3. An anode according to claim 1, wherein said anchoring layers form the external plastic layers of the multiple-layer structure.

4. An anode according to claim 1, wherein the material forming the plastic layers of the multiple layer structure is an alloy of the material forming the target layer.

5. An anode according to claim 1, wherein the plastic layers forming said multiple-layer structure have each a thickness of between 50 micrometers and 300 micrometers.

6. An anode according to claim 1, wherein the material forming the plastic layers in the interposed multiple-layer stucture is a material having a plastic property at the operating temperatures of the anode.

7. An anode according to claim 1, wherein said plastic material is a tungsten alloy or molybdenum alloy with an element chosen from the group that includes tantalum.

8. An anode according to claim 1, wherein the plastic material is one of the elements of the group comprising tantalum and the alloys of this group.

9. An anode according to claim 1, wherein the anchoring layers are formed by a tungsten alloy or molybdenum alloy.

10. An anode according to claim 1, wherein the plastic layers of said multiple-layer structure are formed by a tungsten alloy or molybdenum alloy with one or more metal elements, the plasticity being controlled by the composition of the alloy.

11. An anode according to claim 1, wherein the substrate is a carbon block made of carbon-carbon composite which is metallic.

12. An x-ray tube with an anode having a body or substrate on which a target is formed by a layer of target material, wherein said anode comprises:

a multiple-layer structure as a means for preventing cracks from spreading between said substrate and said target layer, said structure being formed by several plastic layers of alternating high plasticity material and low plasticity material, superimposed in parallel to said target layer;

a first anchoring layer for anchoring said target layer to said multiple-layer structure; and a second anchoring layer for anchoring said multiple-layer structure to said substrate;

said multiple-layer structure being interposed between said first and second anchoring layers.

* * * * *